United States Patent [19]

Dillingham

[11] 4,133,356

[45] Jan. 9, 1979

[54] BAG FILLING KIT

[76] Inventor: Julia E. Dillingham, 414 N. Marshall St., Graham, N.C. 27253

[21] Appl. No.: 827,979

[22] Filed: Aug. 26, 1977

[51] Int. Cl.[2] ..... B65B 39/06

[52] U.S. Cl. ..... 141/316; 141/390; 206/223; 248/99

[58] Field of Search ..... 141/312-317, 141/98, 390, 391, 1-12, 114, 166, 297-300, 331-345, 369, 370, 372, 392; 248/95-101; 220/1 C, 404; 206/223

[56] References Cited

U.S. PATENT DOCUMENTS

| | | | |
|---|---|---|---|
| 861,007 | 7/1907 | Wilhelm | 141/316 |
| 2,819,740 | 1/1958 | Root | 141/316 |
| 2,827,931 | 3/1958 | Melvin | 141/316 |
| 3,818,956 | 6/1974 | Chamberlain | 141/390 |

FOREIGN PATENT DOCUMENTS

| | | | |
|---|---|---|---|
| 772214 | 8/1934 | France | 141/316 |

*Primary Examiner*—Houston S. Bell
*Attorney, Agent, or Firm*—Daniel Jay Tick

[57] ABSTRACT

A bag filling kit has a stand with spaced opposite first and second open ends. The stand tapers down to a small neck. A funnel is insertable in the neck of the stand. A bag supporting shelf is removably insertable in the stand via slots formed through opposite ones of the side walls thereof. A flexible collar-like clasp is positionable around the neck of the stand for releasably clasping the neck of a flexible bag to the outside of the open neck of the stand.

2 Claims, 3 Drawing Figures

BAG FILLING KIT

BACKGROUND OF THE INVENTION

The present invention relates to a bag filling kit.

Although various bag support and filling arrangements have been developed and are described in the published prior art, most of them are for use in machinery, and are not suitable for use in the home for filling a freezer bag with occasional small quantities of material. A device of this type is described in U.S. Pat. No. 2,758,764 of Piazze, for example.

The principal object of the invention is to overcome the limitations and disadvantages of the bag filling devices of the prior art.

An object of the invention is to provide a bag filling kit improved in design and construction.

Another object of the invention is to provide a bag filling kit consisting of simple, durable, parts and components of simple structure, which are inexpensive in manufacture.

Still another object of the invention is to provide a bag filling kit which is usable with facility, convenience and rapidity by anyone, skilled or unskilled, without the need for tools.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 2:
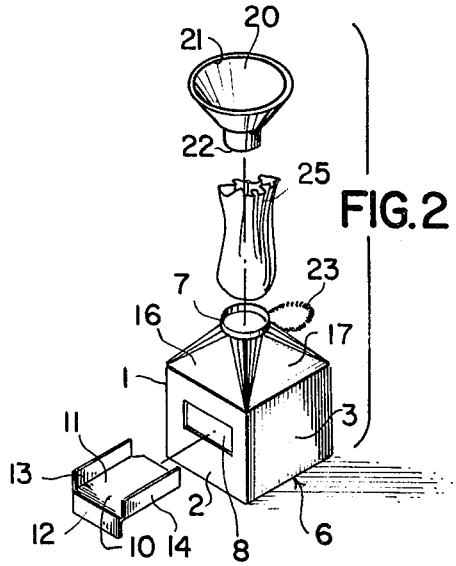
FIG. 2 is a perspective exploded view, on a reduced scale, of the embodiment of FIG. 1.
Figure 3:
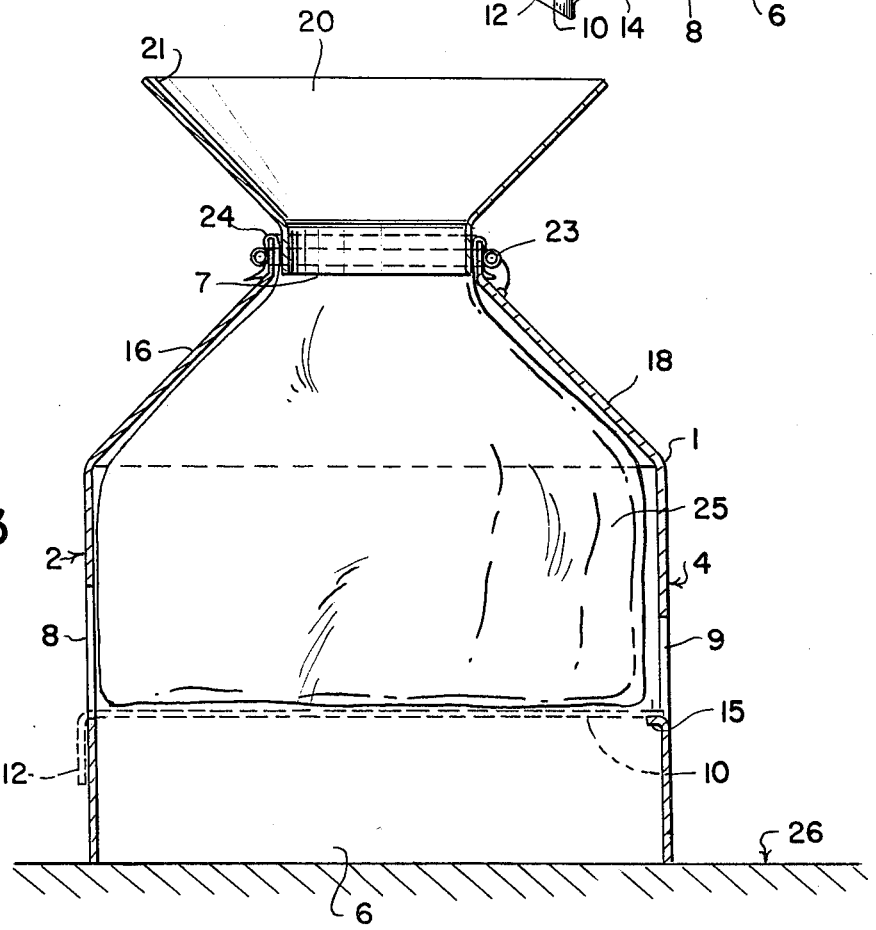
FIG. 3 is a sectional view, on an enlarged scale, taken along the lines III-III, of FIG. 1.

The bag filling kit of the invention comprises a stand 1 having four side walls 2, 3, 4 and 5 and spaced opposite first and second open ends 6 and 7, respectively (FIGS. 2 and 3). The first open end 6 of the stand 1 is rectangular and, more particularly, square.

The second open end 7 of the stand 1 tapers down to a neck smaller than the first end, as shown in the FIGS. The second open end 7 of the stand 1 is circular, as shown in FIG. 2. Slots 8 and 9 are formed in the opposite side walls 2 and 4, respectively of the stand 1 (FIG. 3).

A shelf 10 (FIGS. 2 and 3) is removably insertable into the stand 1 via the slots 8 and 9 of the side walls 2 and 4, respectively, thereof, and is supported by said side walls. As shown in FIG. 2, the shelf 10 has a substantially planar surface 11 with a front flap 12 extending downward from the front edge thereof substantially perpendicularly to said surface and with a pair of side flaps 13 and 14 extending upward from the side edges thereof substantially perpendicularly to said surface.

Figure 1:
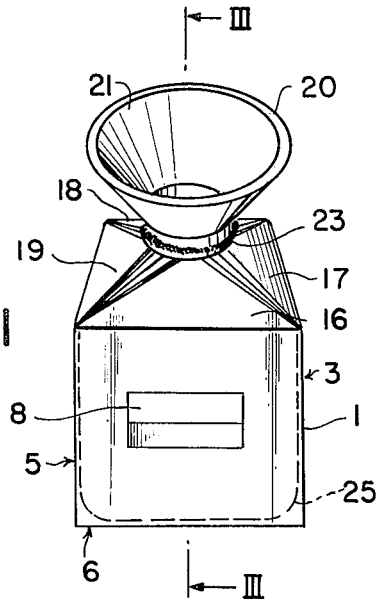
FIG. 1 is a perspective view of an embodiment of the bag filling kit of the invention assembled for use in filling a bag.

An additional shelf-supporting ledge 15 may be provided in the stand 1 at the bottom of the slot 9 (FIG. 3). The sides 2, 3, 4 and 5 of the stand 1 taper down to the second open end or neck 7 via inclined sides 16, 17, 18 and 19, respectively (FIG. 1).

A funnel 20 has side walls and spaced opposite first and second open ends 21 and 22, respectively (FIGS. 2 and 3). The side walls of the funnel 20 taper down from the first open end 21 to the second open end 22, in the usual manner of funnels (FIGS. 1 to 3). The second open end 22 of the funnel 20 has dimensions small enough to fit into the neck 7 of the stand 1, as shown in FIGS. 1 and 3.

A flexible collar-like clasp 23 is positionable around the open neck 7 of the stand 1 (FIGS. 1 to 3) and functions to releasably clasp or clamp the neck 24 of a flexible bag 25 (FIGS. 1 to 3) to the outside of said open neck of said stand with the remainder of the bag in said stand, as shown in FIG. 3. A flexible clasp 23 may comprise a coil spring. The neck 24 of the bag 25 is bent over the neck 7 of the stand 1 whereby the bag is fillable with material of any suitable type, such as, for example, food for a freezer, via the funnel 20, as shown in FIGS. 1 and 3, when the neck of said funnel is inserted into the open neck 24 of the bag 25.

The components of the kit of the invention may comprise any suitable material such as, for example, plastic, ceramic, metal, or the like.

A quart-sized plastic bag 25 is filled by first setting the stand 1 on a supporting surface 26 (FIG. 3). A quart-sized bag 25 is then placed in the stand 1 via the open neck 7 thereof, the neck 24 of the bag folded over the outside of said neck, as shown in FIG. 3.

The bag 25 is then secured by placing the flexible clasp 23 around the neck 24 of said bag over the neck 7 of the stand 1.

The funnel 20 is inserted into the bag 25 via the neck 24 thereof and thus extends through the neck 7 of the stand 1. Material is poured into the bag 25 via the funnel 20. The clasp 23 is then removed and the bag 25 is lifted high enough so that the neck 24 thereof may be held after the funnel is removed. The bag 25 is then sealed by twisting its neck or by applying a rubber band around its neck.

The filled bag 25 is permitted to rest on the supporting surface 26, and the stand 1 is lifted off it.

When a pint-sized plastic bag 25 is to be filled, the aforedescribed steps are followed with the additional step of first inserting the pint bag support shelf 10 in the stand 1 via the slots 8 and 9 thereof. The pint-sized bag 25 then rests on the surface 11 of the shelf 10, in the stand 1, as shown in FIG. 3.

The bag filling kit of the invention comprises simple and durable parts and components, which are inexpensive in manufacture and assembled with facility, convenience and rapidity. The bag filling kit may be used with facility and convenience by anyone, with or without particular skills. The bag filling kit of the invention retains a bag securely during filling.

While the invention has been described by means of a specific example and in a specific embodiment, I do not wish to be limited thereto, for obvious limitations will occur to those skilled in the art without departing from the spirit and scope of the invention.

Kits similar to the type described in the present application are disclosed in the following U.S. Pat. Nos. 1,110,018, issued to Van Scholack on Sept. 8, 1919, 2,758,764, issued to Piazze on Aug. 14, 1956, 2,886,073, issued to Beck on May 12, 1959, 2,247,647, issued to Koch on Apr. 26, 1966 and 3,916,962, issued to Slolt on Nov. 4, 1975.

I claim:

1. A bag filling kit, comprising a hollow stand having side walls and spaced opposite first and second open ends, the second end of the stand tapering down to a neck smaller than the first end, said stand being square at its first open end and circular at its second open end and having slots formed in opposite ones of said side walls;

a funnel having side walls and spaced opposite first and second open ends, the side walls tapering down from the first end to the second end, said second end having a neck having dimensions small enough to fit into the neck of the stand, said funnel being independent and separate from said stand;

a flexible collar-like clasp positionable around the open neck of the stand for releasably clasping the neck of a flexible bag to the outside of the open neck of the stand with the remainder of the bag in the stand, the neck of the bag being bent over the outside of the neck of the stand whereby the bag is fillable with material via the funnel when the neck of the funnel is inserted into the open neck of the bag, said clasp being separate and independent from said stand and said funnel; and a shelf removably insertable into the stand via the slots of the side walls thereof and supported by said side walls.

2. A kit as claimed in claim 1, wherein said shelf has a substantially planar surface having a front edge and a pair of side edges, a front flap extending downward from the front edge thereof substantially perpendicularly to the surface and a pair of side flaps extending upward from the side edges thereof substantially perpendicularly to said surface.

* * * * *